US011242967B1

(12) United States Patent
Tang

(10) Patent No.: US 11,242,967 B1
(45) Date of Patent: Feb. 8, 2022

(54) DISPLAYER SCREEN HANGING LAMP

(71) Applicant: Yong Zhao Tang, Guangdong (CN)

(72) Inventor: Yong Zhao Tang, Guangdong (CN)

( * ) Notice: Subject to any disclaimer, the term of this patent is extended or adjusted under 35 U.S.C. 154(b) by 0 days.

(21) Appl. No.: 17/035,732

(22) Filed: Sep. 29, 2020

(51) Int. Cl.
*F21S 8/00* (2006.01)
*F21V 21/26* (2006.01)
*F21V 21/088* (2006.01)

(52) U.S. Cl.
CPC ..... *F21S 8/036* (2013.01); *F21V 21/088* (2013.01); *F21V 21/26* (2013.01)

(58) Field of Classification Search
CPC .... F21V 21/088; F21V 21/0885; F21V 21/26; F21V 21/30; F21S 6/006; G09F 13/02
See application file for complete search history.

(56) References Cited

U.S. PATENT DOCUMENTS 3,723,720 A * 3/1973 Schmidt ..... F21S 9/02 362/183
6,203,175 B1 * 3/2001 Basacchi ..... F21S 9/02 362/287
8,500,293 B2 * 8/2013 Sutton ..... G03B 15/02 362/137
9,494,844 B2 * 11/2016 Fisher ..... F21V 21/088
10,544,927 B2 * 1/2020 Yen ..... F21V 19/009
2006/0256584 A1 * 11/2006 Paoluccio ..... F21S 2/005 362/652
2009/0316391 A1 * 12/2009 Huang ..... F21V 29/89 362/133
2010/0328933 A1 * 12/2010 Maldonado ..... H05B 47/00 362/183
2015/0362148 A1 * 12/2015 Katz ..... F21V 33/0056 362/16
2017/0299161 A1 * 10/2017 Boorom ..... F21V 29/508
2020/0141564 A1 * 5/2020 Tsai ..... F21V 21/14

* cited by examiner

*Primary Examiner* — Alexander K Garlen

(57) ABSTRACT

The present invention discloses a displayer screen hanging lamp, comprising a lamp body and a fixed bracket, wherein the lamp body comprises a lamp housing, a lens and a light source; the fixed bracket comprises an regulating frame, a support clamping mechanism and two clamping legs; the lamp body is connected and fixed with the regulating frame which is installed onto the support clamping mechanism, the forepart of the bottom of the support clamping mechanism is equipped with two clamping feet extending downward; the whole fixed bracket is clamped onto the displayer via the clamping feet and the clamping legs; the clamping feet clamp the front surface of the top of displayer and the clamping legs are rotated to change the clamping angle to clamp the back of displayer. The present invention can stably and conveniently install the whole lamping lamp onto any displayer of any specification and thickness through two clamping legs, two clamping pieces, two supporting arms and a regulating frame designed for interaction and it does not cover over the displayed content; the regulating frame is set with a clamping leg on its left and right sides respectively, not only solving the problem that the clamping legs interfere with the displayer bracket but also making the lamplight irradiate in front of the displayer. The lamp body is designed with a light-polarizing lens so that the lamplight does not irradiate towards the displayer to prevent the displayer from being not seen clearly due to lamplight reflection.

10 Claims, 3 Drawing Sheets

DISPLAYER SCREEN HANGING LAMP

BACKGROUND OF THE INVENTION

The present invention relates to the technical field of illuminating lamps, particularly relates to a screen hanging lamp mainly used for displayer front partial lighting through cooperation with a displayer.

At present, the apparatuses with displayers such as computers have become common equipment of offices and families. However, when using computers at night, the computer users have easily undergone the eye problems such as being fatigued, sore and dry. Therefore, it is necessary to use a kind of displayer hanging lamps to alleviate the stimulation arising from displayer light. The displayer hanging lamps refer to the illuminating lamps usually fixed onto the tops of displayers and used to illuminate the partial areas in front of displayers; such lamps can prevent the light reflected by the displayers from causing glare and thus increase the users' visual effect while illuminating the keyboards and also can be used normally on the premise that no other lamp are turned on. However, the existing screen hanging lamps usually cause the following problems: Firstly, the position for clamping and fixing is usually designed in the middle of a displayer screen, easily forming interference with the displayer support and thus affecting the stability of the screen hanging lamp; secondly, the position clamped or hanged onto the displayer cover a relatively big area, so the displayed content will be covered over to a relatively big extent when the border of screen is very narrow; thirdly, when a screen hanging lamp clamped in the middle encounters a curved screen with a big radian, some light on both sides of lamp tube will irradiate towards the displayer and its back and thus affect the irradiating effect. Furthermore, the light beam of a conventional screen hanging lamp usually irradiates forward and backwards within a symmetrical scope and as a result, some light irradiates towards the displayer and then reflects back into eyes and thus affects the users' line of sight.

BRIEF SUMMARY OF THE INVENTION

Aiming at the disadvantages of the prior art, the present invention provides a displayer screen hanging lamp which is with a simple structure and based on more reasonable design, does not cover over the displayed content, can be hung up on a displayer more conveniently and does not cause interference.

Aiming to solve the above technical disadvantages, the present invention uses the following technical solution: A displayer screen hanging lamp comprises: a lamp body and a fixed bracket, wherein the lamp body is installed onto the fixed bracket and installed onto the displayer via the fixed bracket; the lamp body comprises a lamp housing, a lens, and a light source, wherein the lens and the light source are installed in the lamp housing; wherein the fixed bracket comprises a regulating frame, a support clamping mechanism, and two clamping legs; the lamp body is connected and fixed to the regulating frame which is installed onto the support clamping mechanism, which is connected and fixed with the two clamping legs via the two corresponding rotatable structures; the fixed bracket is at least equipped with two positions approaching two ends of the lamp body and the hanging lamp is clamped at two positions approaching two edges on the top of the displayer via the support clamping mechanism; a forepart of a bottom of the support clamping mechanism is equipped with two clamping feet extending downward; the fixed bracket is clamped onto the displayer via the clamping feet and the clamping legs, wherein the clamping feet clamp a front surface of the displayer and the clamping legs are rotated to change the a clamping angle to clamp the back of the displayer. The clamping feet can be very short and thus does not cover over the displayed content after being clamped onto the upper frame of a displayer.

The support clamping mechanism comprises two supporting arms and two clamping pieces which are assembled and fixed together while the clamping pieces are fixed onto lower surfaces of the supporting arms; the regulating frame and supporting arms are assembled and fixed together, the clamping feet are installed onto foreparts of the clamping pieces and extend downward, and the clamping legs are pin-jointed and fixed with the clamping pieces.

The lamp body further comprises: a lens hood havinq a groove-shaped structure with an open bottom and an assembly cavity inside; the lens is light-polarizing and is installed in the assembly cavity of the lens hood together with the light source, wherein a lower surface of the light-polarizing lens towards the bottom opening of the light-polarizing lens is planar and the surface of the light-polarizing lens towards the light source is a slanting multi-step dentiform structure; an irradiation scope of a light beam formed via the light-polarizing lens hood is downward paralleling the displayer screen at a position approaching the displayer screen and at an opposing forepart is downward at a slanting angle of 35~55 degrees such as 45 degrees, which can prevent the lamp light from irradiating towards the displayer and then reflecting back into eyes and can prevent the displayer from being not seen clearly.

The lens hood is installed in the lamp housing while two sides of the bottom of the lens hood are designed with two supporting edges extending towards the middle of the bottom opening to support two sides of the light-polarizing lens respectively.

Each clamping leg comprises a connecting segment and a clamping segment while the forepart of the connecting segment is pin-jointed and fixed with the clamping piece; the clamping segment and the connecting segment are integrated and the clamping segment extends backwards and slants downward to form an obtuse-angled bend with the connecting segment so that it can adapt to more displayers with different thickness through rotation.

The clamping segment is heavier than the connecting segment and thicker than the connecting segment, the lower part of the clamping segment is designed with a counterweighting part to make the clamping segment also form a counterweighting structure while the counterweighting part does not protrude from an exterior of the lower part of the clamping segment in order to make the part behind the displayer and the lamp body realize anterior-posterior balance via the counterweighting structure and thus make the lamp body be assembled more stably.

The supporting arm comprises a connector, a connecting arm, and a fixed part, while the connector and the fixed part are connected together via the connecting arm; the connector is designed with a clamping groove opened upward and the regulating frame is installed in the clamping groove; the clamping piece is fixed onto a lower surface of the fixed part.

A rear of the clamping piece is designed with a rotary groove opened backwards, the forepart of the connecting segment of the clamping leg is embedded into the rotary groove and pin-jointed via a spindle into a structure which is horizontally-rotatable. Rotating the clamping legs at a small angle is generally applicable to an ultra-thin displayer and rotating the clamping legs at a big angle is usually applicable to a thickened displayer; the clamping legs can be clamped outwards or inwards, applicable to various displayers.

The regulating frame is a U-shaped support, a main part of the lamp body is embedded into a middle part of the regulating frame; the two side arms of the regulating frame are tightly assembled together with the lamp housing of the lamp body via fixed spindles to form a rotary structure; it is realizable to regulate the irradiating angle of light by rotating the lamp body upwards or downwards to achieve an optimal visual angle.

The displayer screen hanging lamp further comprises a remote controller which forms a remote-control structure of the displayer screen hanging lamp via the remote controller; placing the remote controller on the desktop can conveniently conduct remote-control operations. The remote controller has a light source which can realize an ambient lighting function; after the remote controller is placed beside the displayer screen hanging lamp, its light source can act as an ambient light.

The present invention can stably and conveniently install the whole lamping lamp onto any displayer through two clamping legs, two clamping pieces, two supporting arms and a regulating frame designed for interaction, and can adapt to the displayers of various specifications and different thicknesses and it does not cover over the content displayed by the displayer; the regulating frame is set with a clamping leg on its left and right sides respectively, not only solving the problem that the clamping legs set in the middle interfere with the displayer bracket but also making the lamp body be always located in front of the displayer and thus making the lamplight always irradiate in front of the displayer, not irradiate behind the displayer. Furthermore, the lamp body is designed with a light-polarizing lens so that the lamplight does not irradiate towards the displayer to prevent the displayer from being not seen clearly due to lamplight reflection.

Figure 1:
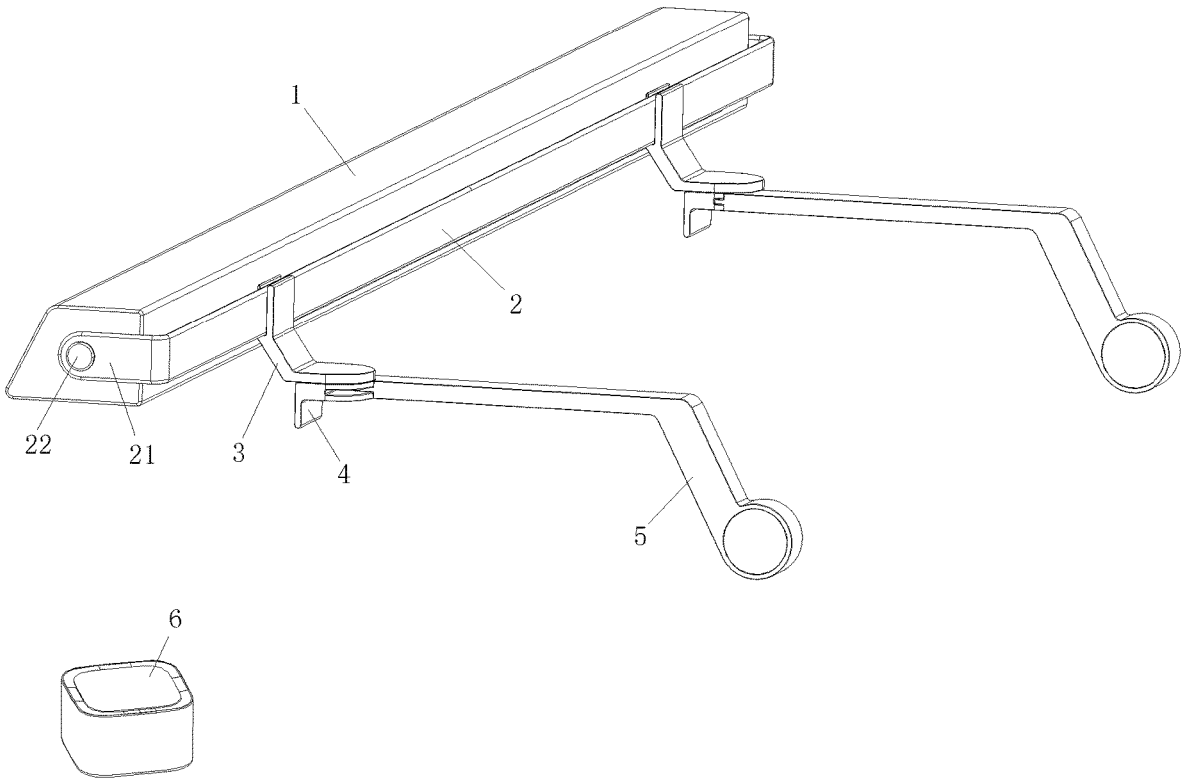
FIG. 1 is an overall structure diagram of the present invention.
Figure 2:
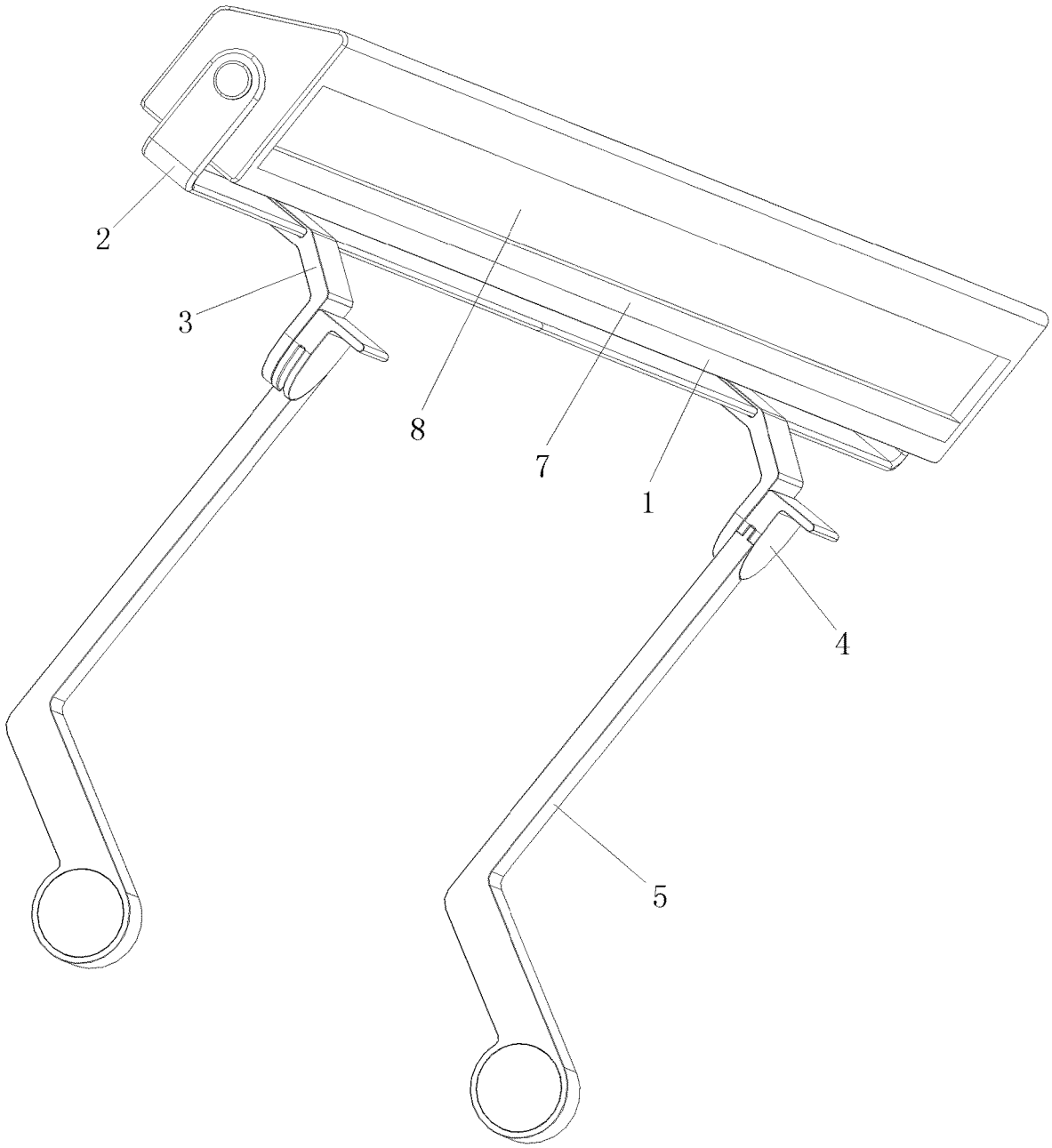
FIG. 2 is an overall structure diagram from another angle of the main part of the present invention.
Figure 3:
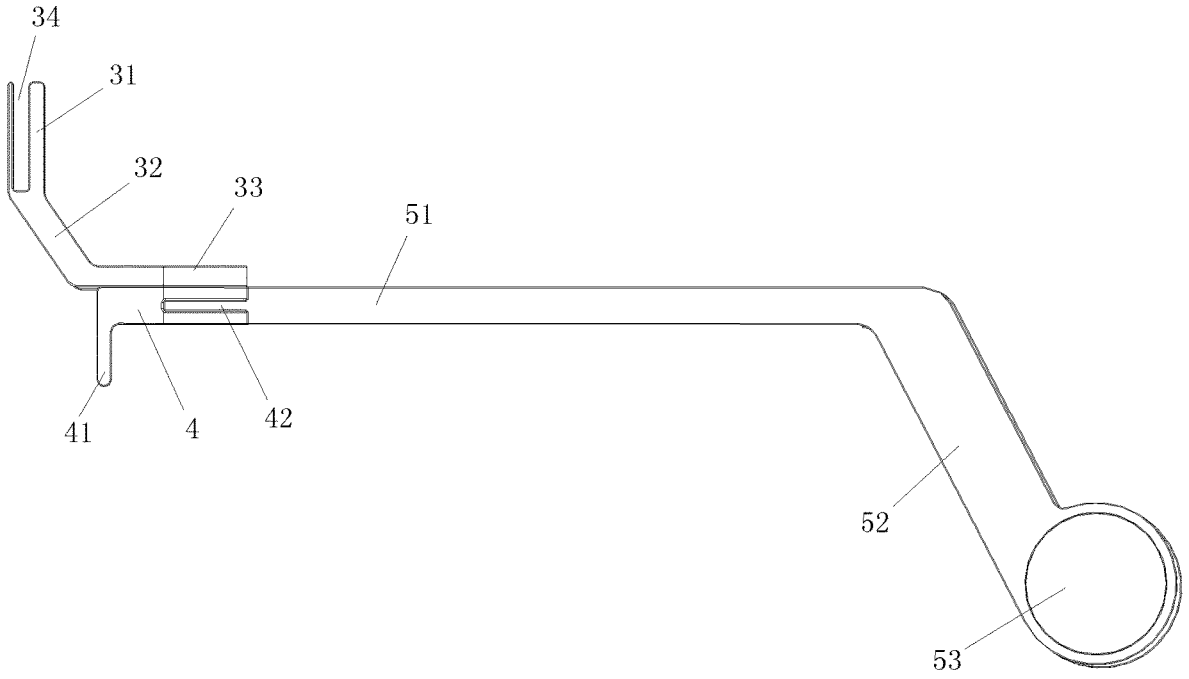
FIG. 3 is a schematic lateral diagram when the clamping legs, the supporting arms and the clamping pieces are assembled together.

In the figures, 1—lamp housing; 2—regulating frame; 21—side arm; 22—fixed spindle; 3—supporting arm; 31—connector; 32—connecting arm; 33—fixed part; 34—clamping groove; 4—clamping piece; 41—clamping foot; 42—rotary groove; 5—clamping leg; 51—connecting segment; 52—clamping segment; 53—counterweighting part; 6—remote controller; 7—lens hood; 71—assembly cavity; 72—supporting edge; 8—light-polarizing lens; 9—light source.

DETAILED DESCRIPTION OF THE INVENTION

In this embodiment, referring to FIGS. 1-4, the displayer screen hanging lamp comprises: a lamp body and a fixed bracket, wherein the lamp body is installed onto the fixed bracket and installed onto the displayer via the fixed bracket; the lamp body comprises a lamp housing 1, a lens, and a light source 9, which is generally a LED light bar, wherein the lens and the light source 9 are installed in the lamp housing; the fixed bracket comprises a regulating frame 2, a support clamping mechanism, and two clamping legs 5; the lamp body is connected and fixed to the regulating frame 2 which is installed onto the support clamping mechanism, which is connected and fixed with two clamping legs via two corresponding rotatable structures; the fixed bracket is equipped with two positions approaching two ends of the lamp body and the hanging lamp is clamped at two positions approaching two edges on the top of the displayer via the support clamping mechanism; a forepart of a bottom of the support clamping mechanism is equipped with two clamping feet 41 extending downward; the w fixed bracket is clamped onto the displayer via the clamping feet 41 and the clamping legs 5, wherein the clamping feet 41 clamp a front surface of the displayer and the clamping legs 5 are rotated to change a clamping angle to clamp the back of the displayer. The clamping feet 41 can be very short and thus does not cover over the displayed content after being clamped onto the upper frame of a displayer.

The support clamping mechanism comprises two supporting arms 3 and two clamping pieces 4 which are assembled and fixed together while the clamping pieces 4 are fixed onto lower surfaces of the supporting arms 3; the regulating frame 2 and supporting arms 3 are assembled and fixed together, the clamping feet 41 are installed onto the foreparts of the clamping pieces 4 and extend downward, and the clamping legs 5 are pin-jointed and fixed with the clamping pieces 4.

Figure 4:
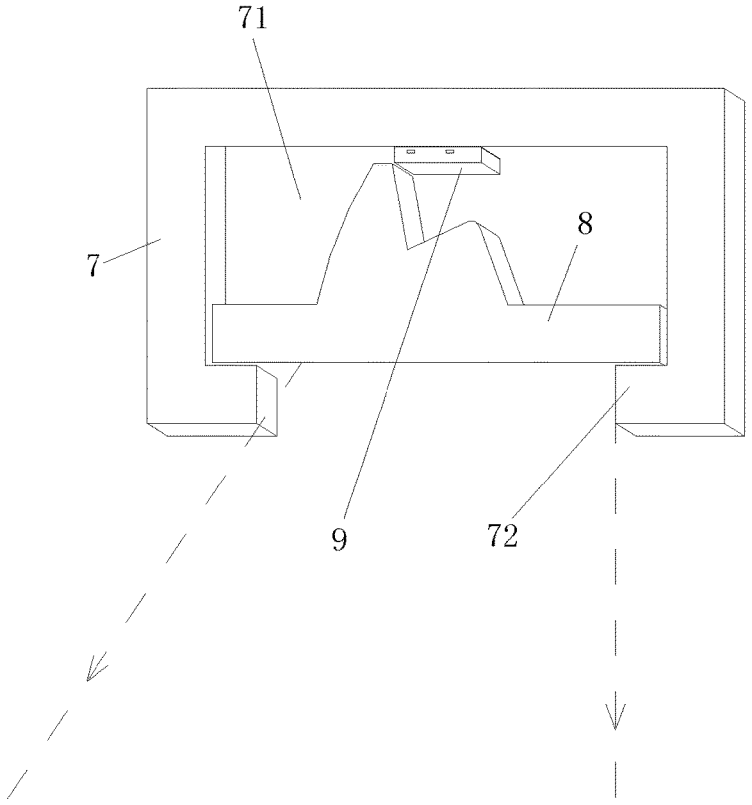
FIG. 4 is a schematic diagram of the internal structure of the lamp body and the irradiation scope of light beam.

The lamp body further comprises: a lens hood 7 having a groove-shaped structure with an open bottom and an assembly cavity 71 inside; the lens is a light-polarizing lens 8 and is installed in the assembly cavity 71 of the lens hood 7 together with the light source 9, wherein a lower surface of the light-polarizing lens 8 towards the bottom opening of the lens hood 7 is planar and the surface of the light-polarizing lens 8 towards the light source 9 is a slanting multi-step dentiform structure; an irradiation scope of a light beam formed via the light-polarizing lens 8, as shown in FIG. 4, is downward paralleling the displayer screen at a position approaching the displayer screen and at an opposing forepart is downward at a slanting angle of 35~55 degrees such as 45 degrees, which can prevent the lamp light from irradiating towards the displayer and then reflecting back into eyes and can prevent the displayer from being not seen clearly.

The lens hood 7 is installed in the lamp housing 1 while two sides of the bottom of the lens hood 7 are designed with two supporting edges 72 extending towards the middle of the bottom opening to support the two sides of the light-polarizing lens 8 respectively.

Each clamping leg 5 comprises a connecting segment 51 and a clamping segment 52 while the forepart of the connecting segment 51 is pin-jointed and fixed with the clamping piece 4; the clamping segment 52 and the connecting segment 51 are integrated and the clamping segment 52 extends backwards and slants downward to form an obtuse-angled bend with the connecting segment 51 so that it can adapt to more displayers with different thickness through rotation.

The clamping segment 52 is heavier than the connecting segment 51 and thicker than the connecting segment 51, the lower part of the clamping segment 52 is designed with a counterweighting part 53 to make the clamping segment 52 also form a counterweighting structure while the counterweighting part does not protrude from an exterior of the lower part of the clamping segment 52 in order to make the part behind the displayer and the lamp body realize anterior-posterior balance via the counterweighting structure and thus make the lamp body be assembled more stably.

The supporting arm 3 comprises a connector 31, a connecting arm 32, and a fixed part 33, while the connector 31 and the fixed part 33 are connected together via the connecting arm 32; the connector 31 is designed with a clamping groove 34 opened upward and the regulating frame 2 is installed in the clamping groove 34; the clamping piece 4 is fixed onto a lower surface of the fixed part 33.

A rear of the clamping piece 4 is designed with a rotary groove 42 opened backwards, the forepart of the connecting segment 51 of the clamping leg 5 is embedded into the rotary groove 42 and pin-jointed via a spindle into a structure which is horizontally rotatable. Rotating the clamping legs 5 at a small angle is generally applicable to an ultra-thin displayer and rotating the clamping legs at a big angle is usually applicable to a thickened displayer; the clamping legs 5 can be clamped outwards or inwards, applicable to various displayers.

The regulating frame 2 is a U-shaped support, a main part of the lamp body is embedded into a middle part of the regulating frame 2; the two side arms 21 of the regulating frame 2 are tightly assembled together with the lamp housing 1 of the lamp body via fixed spindles 22 to form a rotary structure; it is realizable to regulate the irradiating angle of light by rotating the lamp body upwards or downwards to achieve an optimal visual angle.

The displayer screen hanging lamp also comprises a remote controller 6 and forms a remote-control structure of the whole screen hanging lamp via the remote controller 6; placing the remote controller 6 on the desktop can conveniently conduct remote-control operations. The remote controller 6 has a light source which can realize the ambient lighting function and the light source of the remote controller 6 can act as an ambient light.

The present invention has been described in detail; the described embodiments are merely the preferred embodiments of the present invention and cannot be understood to limit the embodiment scope of the present invention; equivalent changes and modifications made within the scope of the present application should belong to the scope covered by the present invention.

What is claimed is:

1. A displayer screen hanging lamp comprises: a lamp body and a fixed bracket, wherein the lamp body is installed onto the fixed bracket and installed onto the displayer via the fixed bracket; the lamp body comprises a lamp housing, a lens, and a light source, wherein the lens and the light source are installed in the lamp housing; wherein the fixed bracket comprises a regulating frame, a support clamping mechanism, and two clamping legs; the lamp body is connected and fixed to the regulating frame which is installed onto the support damping mechanism, which is connected and fixed with the two clamping legs via the two corresponding rotatable structures; the fixed bracket is at least equipped with two positions approaching two ends of the lamp body and the hanging lamp is clamped at the two positions approaching two edges on the top of the displayer via the support clamping mechanism; a forepart of a bottom of the support clamping mechanism is equipped with two clamping feet extending downward; the fixed bracket is clamped onto the displayer via the clamping feet and the clamping legs, wherein the clamping feet clamp a front surface of the displayer and the clamping legs are rotated to change a clamping angle to clamp the back of the displayer.

2. The displayer screen hanging lamp in accordance with claim 1, wherein the support clamping mechanism comprises two supporting arms and two clamping pieces which are assembled and fixed together while the clamping pieces are fixed onto lower surfaces of the supporting arms; the regulating frame and supporting arms are assembled and fixed together, the clamping feet are installed onto foreparts of the clamping pieces and extend downward, and the clamping legs are pin-jointed and fixed with the clamping pieces.

3. The displayer screen hanging lamp in accordance with claim 1, wherein the lamp body further comprises: a lens hood having a groove-shaped structure with an open bottom and an assembly cavity inside; the lens is a light-polarizing lens and is installed in the assembly cavity of the lens hood together with the light source, wherein a lower surface of the light-polarizing lens towards the bottom opening of the lens hood is planar and the surface of the light-polarizing lens towards the light source is a slanting multi-step dentiform structure; an irradiation scope of a light beam formed via the light-polarizing lens hood is downward paralleling the displayer screen at a position approaching the displayer screen and at an opposing forepart is downward at a slanting angle of 35~55 degrees.

4. The displayer screen hanging lamp in accordance with claim 3, wherein the lens hood is installed in the lamp housing while two sides of the bottom of the lens hood are designed with two supporting edges extending towards the middle of the bottom opening to support two sides of the light-polarizing lens respectively.

5. The displayer screen hanging lamp in accordance with claim 2, wherein each damping leg comprises a connecting segment and a clamping segment while the forepart of the connecting segment is pin jointed and fixed with the clamping piece; the damping segment and the connecting segment are integrated and the clamping segment extends backwards and slants downward to form an obtuse-angled bend with the connecting segment.

6. The displayer screen hanging lamp in accordance with claim 5, wherein the clamping segment heavier than the connecting segment and thicker than the connecting segment, the lower part of the clamping segment is designed with a counterweighting part to make the clamping segment also form a counterweighting structure while the counterweighting part does not protrude from an exterior of the lower part of the clamping segment.

7. The displayer screen hanging lamp in accordance with claim 5, wherein the supporting arm comprises a connector, a connecting arm, and a fixed part, while the connector and the fixed part are connected together via the connecting arm; the connector is designed with a groove opened upward and the regulating frame is installed in the groove; the clamping piece is fixed onto a lower surface of the fixed part.

8. The displayer screen hanging lamp in accordance with claim 5, wherein a rear of the clamping piece is designed with a rotary groove opened backwards, the forepart of the connecting segment of the clamping leg is embedded into the rotary groove and pin-jointed via a spindle into a structure which is horizontally rotatable.

9. The displayer screen hanging lamp in accordance with claim 7, wherein the regulating frame is a U-shaped support, main part of the lamp body is embedded into a middle part of the regulating frame; the two side arms of the regulating frame are tightly assembled together with the lamp housing of the lamp body via fixed spindles to form a rotary structure.

10. The displayer screen hanging lamp in accordance with claim 1, further comprising a remote controller which forms a remote-control structure of the displayer screen hanging lamp via the remote controller; the remote controller having a light source which can realize an ambient lighting function.

* * * * *